United States Patent [19]

Brunner

[11] Patent Number: 4,529,990

[45] Date of Patent: Jul. 16, 1985

[54] ANTENNA SYSTEM FOR A JAMMING TRANSMITTER

[75] Inventor: Anton Brunner, Wangen-Starnberg, Fed. Rep. of Germany

[73] Assignee: Siemens Aktiengesellschaft, Berlin & Munich, Fed. Rep. of Germany

[21] Appl. No.: 194,878

[22] Filed: Oct. 7, 1980

[30] Foreign Application Priority Data

Oct. 22, 1979 [DE] Fed. Rep. of Germany ..... 2942557

[51] Int. Cl.[3] ..... H01Q 3/20

[52] U.S. Cl. ..... 343/761; 343/779; 343/853

[58] Field of Search ..... 343/872, 876, 781 CA, 343/781 R, 5 R, 761, 779, 853

[56] References Cited

U.S. PATENT DOCUMENTS

| | | | |
|---|---|---|---|
| 3,171,125 | 2/1965 | Butler | 343/18 E |
| 3,795,004 | 2/1974 | Meek et al. | 343/781 CA |
| 3,984,837 | 10/1976 | Tatnall | 343/872 |

*Primary Examiner*—Eli Lieberman

*Attorney, Agent, or Firm*—Hill, Van Santen, Steadman & Simpson

[57] ABSTRACT

This invention relates to an antenna system for a jamming transmitter which is intended to protect a remote object which is remote from the jamming transmitter as well as itself or an object in the immediate vicinity of the jamming transmitter. Known jammer antennas for this purpose radiate either a pencil beam which presents considerable problems in the alignment and orientation and tracking in two planes or alternatively such known antennas are designed as omni directional antenna which however have low antenna gain and are easily detected. In the present invention the difficulties of the prior art are eliminated in that a separate antenna is provided for external or foreign protection and a separate antenna for self protection which antennas produced in the first plane a sharply focused pattern and in a plane perpendicular thereto a radiation pattern (7, 8) which is optimized for external or foreign protection or self protection, respectively. The two antennas can be switched and are structurally combined and designed to be jointly rotatable in the first plane. A single antenna can also be provided which can be tilted between two positions one for external or foreign protection and the other position for self protection so as to transmit and radiate instead of two separately optimized patterns a single pattern which is a mean of the two desired patterns.

14 Claims, 9 Drawing Figures

ANTENNA SYSTEM FOR A JAMMING TRANSMITTER

BACKGROUND OF THE INVENTION

1. Field of the Invention

This invention relates in general to an antenna system for a jamming transmitter which is intended to protect an object remote from the transmitter as well as protect the transmitter itself and/or objects in its immediate proximity.

2. Description of the Prior Art

A jammer antenna system of this type is intended to radiate jamming or interfering radiation from the ground or ship against airplanes flying at a constant height or from the airplane against objects on the ground or on the water so that independently of the distance the same jamming effect is obtained and that the radiated signal serves to protect the transmitting location as well as protect external objects.

So as to achieve an optimum jamming effect at the receiving location jamming antennas frequently have a pencil shaped beam, however, difficulties arise because of the problem of aligning and tracking in two planes for example, in the horizontal and vertical planes of the fine beam. An omni directional antenna comprises an antenna with the lowest antenna cost but has the disadvantages that the omni directional antenna has very low gain and is very easily detected.

SUMMARY OF THE INVENTION

The present invention makes it possible to decrease the cost which is necessary in the case of a pencil beam antenna on one hand and to avoid the disadvantages of an omni directional antenna system on the other hand. The antenna system is intended to be capable of simple, small, light weight and rapid motion so that it can be universally utilized and can be aligned with various objects and in a very rapid manner.

According to the invention this object is achieved in that for external protection and for self protection a separate antenna is provided, respectively, such that the two antennas have in a first plane a sharply focused radiation pattern and in the second plane which is perpendicular to the first plane they exhibit a radiation pattern which is optimized for external protection or self protection, respectively, and wherein the two antennas between which it is possible to switch the radiating signal are structurally combined and designed to be commonly rotatable in the first plane.

Another solution to the problem consists in providing a single antenna for external protection and for self protection which in the first plane produces a sharply focused beam radiation pattern and in a second plane which is perpendicular to the first plane produces a radiation pattern which although not optimized for external protection or self protection, respectively, has a mean diagram common to the two types of protection. Furthermore, the antenna in the second plane is designed so that it can be tilted so that its direction of maximum radiation or mean beam direction corresponds to the direction which is optimum for external protection (which has a small angle of elevation) and in the other instance corresponds to the direction which is optimum for self protection (which requires larger angles of elevation). The antenna can be designed to be rotatable in the first plane and the antenna can be switched for operation between external protection and self protection by common control coordinated with the sweeping and tilt control. An antenna of this system can be designed in a very simple manner and which would be simpler than the structure mentioned above which requires two separate antennas.

An antenna system according to the invention needs only follow up in one plane and therefore it can be designed so that it is movable only in the one plane and can be directed by means of a tracking system. In the plane perpendicular to the first plane the radiation pattern covers a large angle of elevation depending upon which of the antennas is connected with the external protection or self protection, respectively. With the antenna system designed according to the invention, a jamming transmitter can be matched so as to meet the prevailing threat situation and it is possible to rapidly switch back and forth between several objects which are being observed.

Normally the first plane is the horizontal plane, in other words, the azimuth plane and the second plane is the vertical plane or the elevation plane. Follow-up is then accomplished in the horizontal plane whereas, by contrast, in the elevation plane, the suitable broad shaped radiation pattern is employed so that the angle of elevation required is in each instance covered for external protection or self-protection.

Other objects, features, and advantages of the invention will be readily apparent from the following description and claims when read in view of the drawings in which

DESCRIPTION OF THE PREFERRED EMBODIMENTS

As described above, an antenna follow-up system can be accomplished in only one plane; for example, the horizontal plane, and a suitably formed broader radiation pattern can be employed in the elevation plane through which the angle of elevation allows the range under consideration to be covered. The optimum configuration and shaping of the radiation pattern in the angle of elevation assuming constant flight altitude or a jamming interference effect which is effective up to a specific altitude depends upon the objective of the jamming transmitter.

Figure 1:
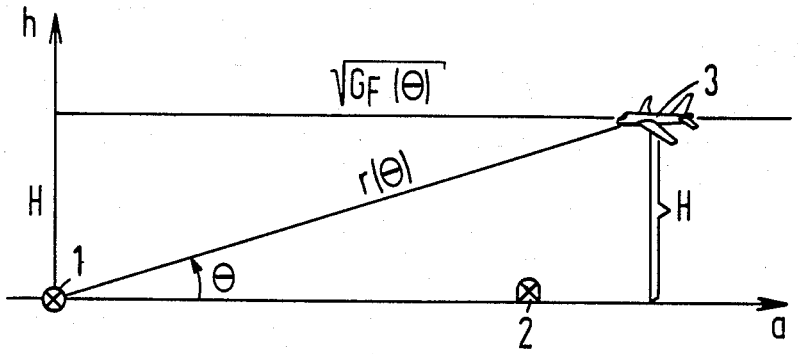
FIG. 1 is a side view for illustrating the optimum external protection radiation pattern.

FIG. 1 illustrates external or foreign protection in which the horizontal distance a is plotted on the abscissa and the flight altitude h is plotted as the ordinate. If a jammer transmitter 1 is to protect an external or foreign object 2, it is important that a target 3 be subjected with a specific jamming interference power independently of the distance $r(\theta)$ relative to the jamming transmitter 1. If it is assumed that the enemy target 3 lies at a constant altitude H and that it is to be jammed from the ground or from a ship, the radiated jamming power $G_F(\theta)$ must increase with the distance $r^2(\theta)$ between the jamming transmitter 1 and the target 3 so that a constant jamming power will arrive at the target location. The following relationship is then valid:

$$G_F(\theta)=\text{const.}\cdot r^2(\theta) \tag{1}$$

From the geometry of FIG. 1 it follows:

$$\sin\theta=H/r(\theta) \tag{2}$$

Since the flight altitude H is constant, there results $$G_F(\theta) = \frac{\text{const.}}{\sin^2(\theta)} = \text{const.}\cdot\text{cosec}^2(\theta) \tag{3}$$

Thus, for external or foreign protection without a vertical follow-up the known cosecant-square-law can be utilized. In the coverage diagram shown in FIG. 1 which corresponds to a polar field intensity represents due to the linear reduction in the field intensity with distance, the line of constant flight altitude can be considered as a relative field intensity pattern for the jamming or interfering antenna. The law likewise applies when the jammer 1 is mounted on board a flying object and is to jam or interfere with a target 3 located on the ground. The illustration of FIG. 1 is such case can then merely be turned upside down to illustrate such a situation. In such example, the jamming transmitter 1 will be located at the altitude H. The expression in the diagram $G_F(\theta)$ then coincides with ground.

Figure 2:
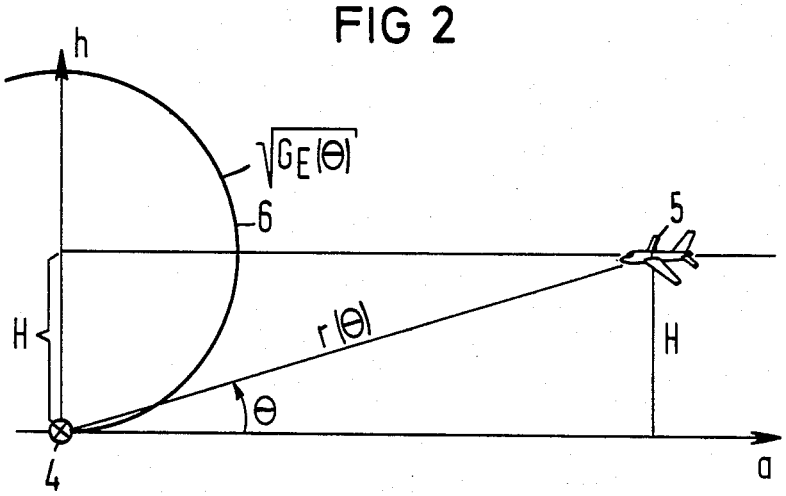
FIG. 2 is an illustration of the formation of optimum self protection radiation pattern.

FIG. 2 illustrates how self protection is accomplished wherein the horizontal distance a is plotted on the abscissa and the flight altitude h is plotted on the ordinate. For the case in which the jamming transmitter 4 is protecting itself or an object in its immediate vicinity entirely different conditions exist than in the case of external or foreign protection illustrated in FIG. 1. The radar on board the target 5 has as is assumed detected the system of the jamming transmitter 4 and receives a useful power or output N which is dependent upon the radar or backfire cross section of the system. This useful power depends upon the distance r according to the function.

$$N = \frac{\text{const.}}{r^4(\theta)} \tag{4}$$

Effective jamming or interference must function independently of the distance r; in other words, the ratio of jamming or interference power S to useful power N cannot be permitted to be dependent upon $r(\theta)$. The jamming or interference power arriving at the target results from the power or output signal $G_E(\theta)$ radiated from the jamming or interfering transmitter antenna according to the equation $$S = G_E(\theta)\frac{\text{const.}}{r^2(\theta)} \tag{5}$$

From equations 4 and 5 it follows:

$$S/N=G_E(\theta)\cdot\text{const.}\cdot r^2(\theta) \tag{6}$$

If S/N is to be independent of $r(\theta)$, then the following relationship is valid:

$$G_E(\theta) = \frac{\text{const.}}{r^2(\theta)} \tag{7}$$

According to equation 2 there results $$G_E(\theta)=\text{const.}\cdot\sin^2(\theta) \tag{8}$$

In the diagram illustrated in FIG. 2 the relative field intensity or radiation pattern $G_E(\theta)$ of the jamming transmitter antenna 4 results in a semi-circle 6. The angular range in proximity to the zenith or nadir, respectively, in the case of an airborne jammer, accordingly, requires the greatest proportion of energy. However, due to the short time of the fly-over phase and due to the restricted handling capability this becomes unimportant at this time. It is therefore desirable to track the semicircular shape in the coverage diagram only up to a median angle of elevation and to then allow the radiation pattern to break off from the semicircle. For ground proximate angles of elevation in the lowest portion of the semicircle, by contrast, the diagram signal level should be somewhat raised for the purpose of balancing an equalizing ground interference effects.

Figure 3:
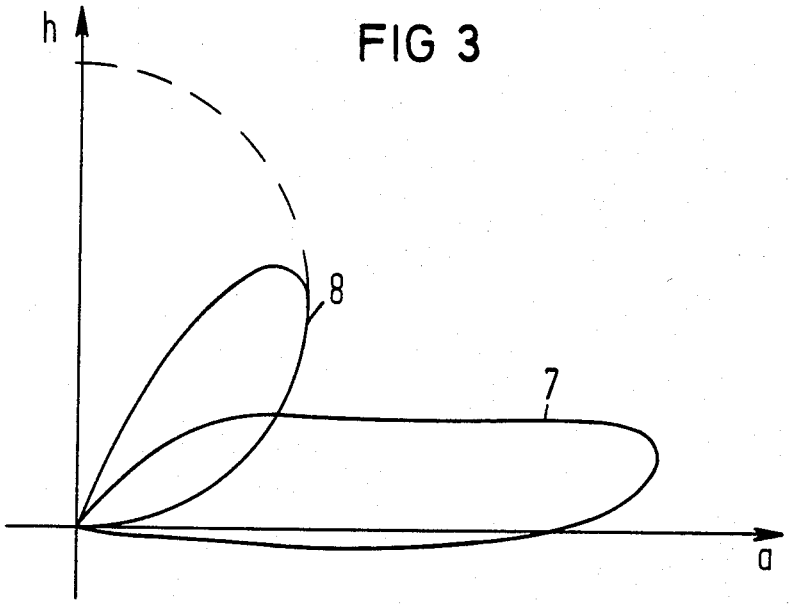
FIG. 3 illustrates optimum jammer radiation antenna vertical radiation patterns for both external protection and self protection.

For the two instances of external protection and self protection the optimum radiation pattern for jamming transmitters is illustrated in FIG. 3. The optimum radiation pattern for external or foreign protection is shown by the antenna pattern 7 and the optimum radiation diagram for self protection is shown by radiation diagram 8.

Figure 4:
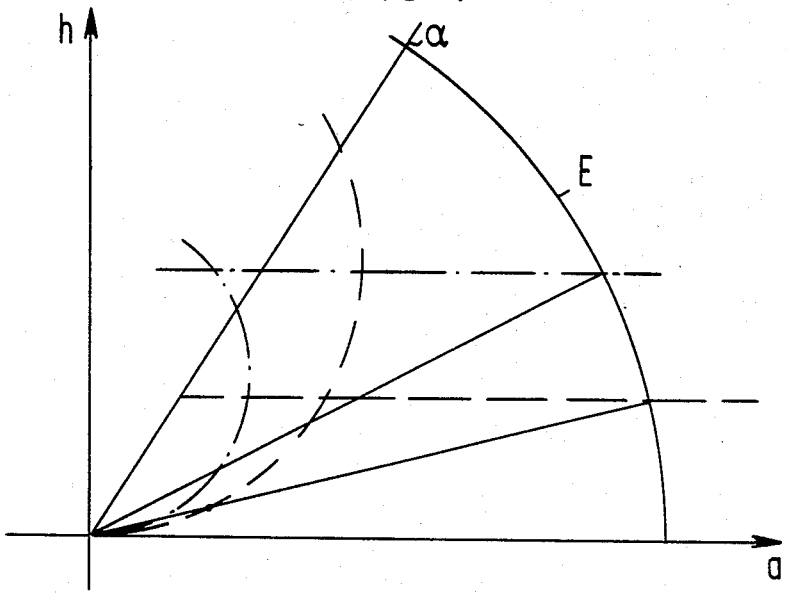
FIG. 4 is a self protection radiation pattern for different flight altitudes.

The relationship between the optimum self-protection diagrams and various approach altitudes can be observed from considering FIG. 4. In the case of a lower approach more jamming power is required. The diagram shape and the antenna configuration is not influenced by this fact. The critical angle is illustrated by $\alpha$ and the maximum distance with E. By contrast the diagram for external and foreign jamming through the maximum range depends upon the flight altitude and is determined by the ratio of detection altitude to range. This also influences the shape of the antenna and its design.

To obtain the radiation pattern illustrated in FIG. 3 a doubly curved reflector can be utilized. The various radiation patterns of FIG. 3 can be produced by different antennas or reflectors. If a jamming transmitter has only a single of the two objects or functions, that is, satisfying either self protection or external or foreign protection then it is sufficient to select a matching arrangement. If by contrast the jamming transmitter due to the problem must protect itself or another object then this can be accomplished by using a combination of two antennas which is possible in a compact manner particularly in the frequency range S/Ku-band. The antenna arrangements illustrated in FIGS. 5 through 8 can be utilized for generating such patterns.

Figure 5:
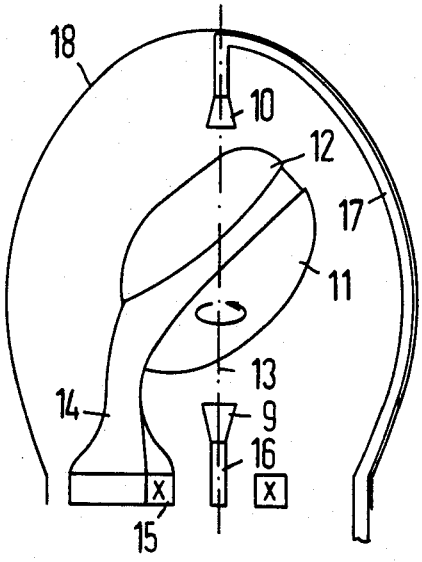
FIG. 5 is a side plan view of an antenna according to the invention.

FIG. 5 illustrates an embodiment wherein a pair of reflectors 11 and 12 are mounted for rotation together and such antennas are fed by stationary radiators or antennas 9 and 10. The two primary radiators of the antenna 9 and 10 are in the form of stationary horn type radiators which are respectively fed by feed lines 16 and 17 respectively and such radiators 9 and 10 are stationary and are mounted on opposite sides of the reflectors 11 and 12 with the radiator 9 feeding the reflector 11 and the radiator 10 feeding the reflector 12 as shown. The reflectors are mounted back-to-back to each other and are supported on a common vertical axis 13. A supporting mounting 14 supports the reflectors 11 and 12 and the support mounting 14 is mounted on a bearing 15 which is centered on the axis between the radiators 9 and 10 so that the reflectors 11 and 12 rotate on the dash-dotted line between the reflectors 9 and 10.

The two feed lines 16 and 17 are stationary as are the horn-type radiators 9 and 10 and the feed line 17 for the upper horn-type radiator 10 extends upwardly as shown. Minor shadowings might result from the feed line 17 however, this does not substantially influence the overall radiation pattern.

The lower antenna 9 and reflector 11 serve as the external or foreign protection antenna and the upper antenna 10 and reflector 12 provides self protection. The entire antenna is enclosed in a stationary radome 18 which can consist of a low-loss polyurethane-integral foam to which the feed line 17 for the upper horn radiator 10 is attached.

So as to avoid directionally dependent polarization for the stationary radiators 9 and 10 can be selected to have circular polarization. The obvious application of spiral antennas will not be possible in many instances due to the restricted efficiency. Therefore, circularly polarized horn-type radiators are advantageously employed for which the frequency band widths of up to an octave can be obtained. The greater band width of the linearly polarized horn-type radiators, which are fed by ridge wave guides, would, with a full rotating metal reflector lead to a directionally dependent linear polarization. Thus, in FIG. 5 the two reflectors 11 and 12 rotate on a common axis supported by bearing 15 and the feed antennas 9 and 10 are stationary.

Figure 6:
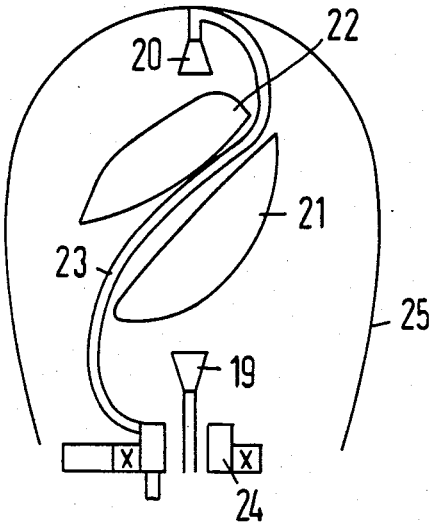
FIG. 6 is a side plan view of a modification of the invention.

FIG. 6 illustrates a modification of the embodiment in which only one of the primary radiators, particularly the horn-type radiator 19 is stationary and the other horn-type radiator 20 together with the two reflectors 21 and 22 which are inclined and mounted one above the other with a back-to-back relationship are rotatably mounted about a common vertical axis. The feed line 23 to the upper horn-type radiator 20 thus jointly rotates with the two reflectors 21 and 22 and is connected by way of a rotary coupling 24 to the jamming transmitter. In the case of this antenna arrangement there is no shadowing by a feeder line and for the upper rotating antenna 20 a random polarization for example, a linear polarization of 45° can be selected. In the antenna illustrated in FIG. 6, the antenna consists of the stationary horn-type radiator 19 and rotating reflector 21 which serves the purpose of external protection and the upper antenna consisting of the rotating horn-type radiator 20 and the rotating reflector 22 serve for self protection. The antenna of FIG. 6 is also covered with a radome 25 for protection.

In the embodiments of FIGS. 5 and 6 the reflectors of the two antennas are mounted back-to-back and as a consequence the direction of maximum radiation of the two antennas are offset relative to each other by 180° in azimuth. However, due to the different requirements for the two antennas this does not cause any serious problems.

Figure 7:
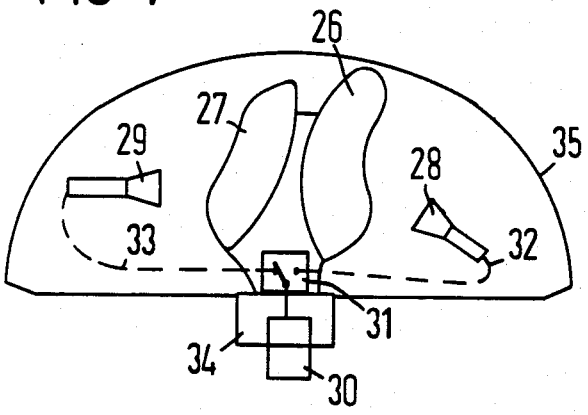
FIG. 7 is a plan view of a further modification of the invention.

FIG. 7 illustrates a further embodiment of the invention for both external protection and self protection. In this example, two reflectors 26 and 27 are mounted at about the same level with a back-to-back relationship to each other. Both of the reflectors 26 and 27 together with the two primary radiators 28 and 29 which may be of a horn type and are associated respectively with the reflectors are rotatably mounted about a common vertical axis. A rotating coupling joint 30 is provided for the purpose of electrical connection to the rotatably mounted horn type radiators 28 and 29. A switch 31 for switching over between external and self protection is mounted between the rotating coupling joint 30 which can be designed to be in the form of a single channel and the feeder lines 32 and 33 which feed the two horn type radiators 28 and 29. The rotary base of the entire antenna is indicated by numeral 34. The polarization can be randomly selected for the two adjacently arranged antennas however preferably it is linear at 45°. All the arrangement requires a greater overall diameter than the arrangements illustrated in FIGS. 5 and 6. The arrangement of FIG. 7 is lower than such embodiments. Also this antenna is covered with a radiation transmissive radome 36.

Figure 8:
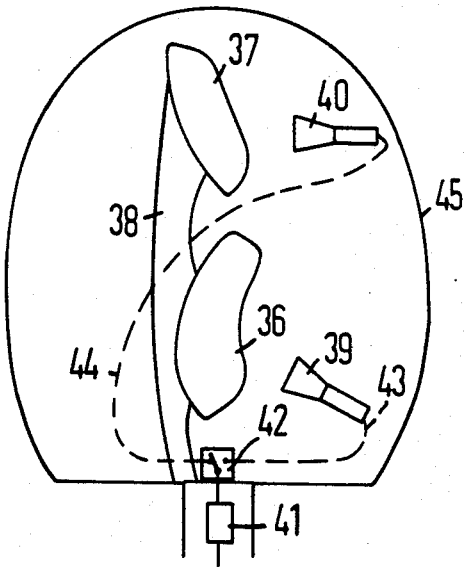
FIG. 8 illustrates an additional modification of the invention.

FIG. 8 illustrates an embodiment wherein common azimuth direction or primary radiation of the two antennas is achieved with the antennas mounted above each other. The two reflectors 36 and 37 are mounted one above the other on a common support mounting 38 and receive radiation from two horn-type radiators 39 and 40, respectively. Both of the reflectors 36 and 37 together with the two horn-type radiators 39 and 40 associated with them are rotatably mounted about a common vertical axis. For electrical connection to the rotatably mounted horn-type radiators 39 and 40 a rotary coupling joint 41 is provided. A switch 42 allows switching over between external and self protection and is mounted between the rotary coupling joint 41 designed as a single channel and the feeder lines 43 and 44 to the two primary radiators 39 and 40. The polarization of both of the antennas can be randomly selected however it is preferable to make them linear and to select 45°. The arrangement shown in FIG. 8 is higher than that illustrated in FIG. 7, however, it requires a smaller diameter. The antenna of FIG. 8 is also surrounded by a radiation transmissive radome 45.

The various embodiments illustrated in FIGS. 7 and 8 can be basically expanded by adding additional radiators at both sides of the horn-type radiators so that they produce radar operation with monopulse reception for azimuth follow-up. However, the frequency band width must be narrowed down and the antenna dimension possibly enlarged.

Figure 9:
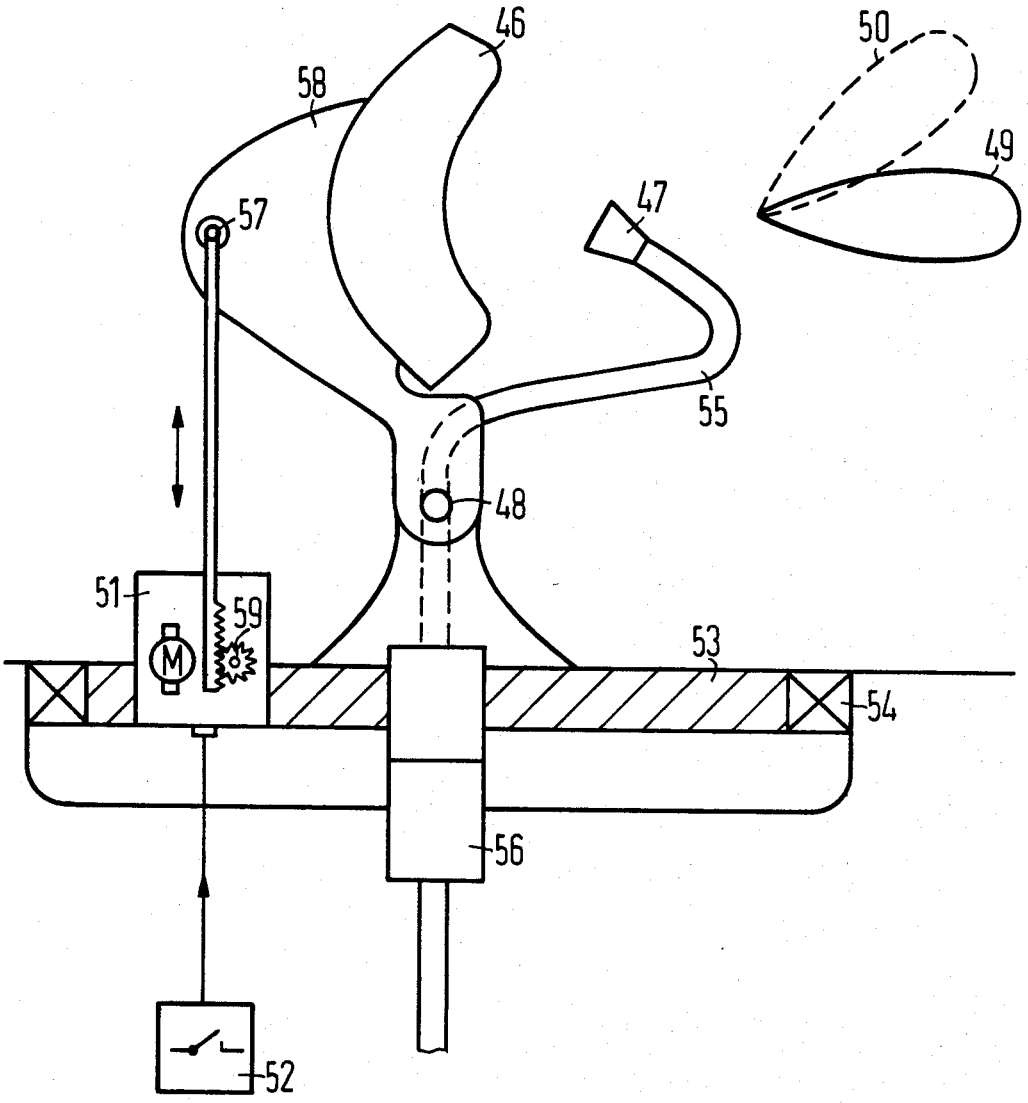
FIG. 9 illustrates an antenna system according to the invention with a single antenna not only for external protection but also for self-protection.

A less costly antenna embodiment can be obtained when only the coarse diagram shape is required. In this case the embodiment illustrated in FIG. 9 which has only a single antenna which consists of a reflector 46 and a primary radiator 47 and which can be tilted by way of a joint 48. The vertical diagrams for the external or foreign protection and the self protection 49 and 50 respectively do not have different shapes as illustrated in FIG. 3 but a common mean diagram shape results. The two different directions of primary radiation of the antenna are adjusted and set by the angles to which they are tilted. The motor driven tilting installation 51 is connected with a coupling linkage 57 to the reflector 46 supporting mounting 58 so that the linkage 57 and gear 59 which engages a rack on the linkage 57 causes the reflector 46 to move upwardly and downwardly about a horizontal axis 48 as the motor is actuated. The optimum range over the entire angle of elevation range is not obtained in this embodiment. The motor driven tilting installation 51 is moved by closing switch 52 which energizes the motor of the tilting mechanism 51 from one tilted position for external or foreign protection or to the other position for self protection as desired. The entire antenna is mounted with its base on a rotary table 53 which rotates about a vertical axis and which is supported on a rotary bearing 54. The coupling of the feed wave guide 55 for the primary radiator 47 passes through a rotary coupling or joint 56.

For use of the jammer antenna combination according to the invention, it is assumed that a radar apparatus or reconnaissance or search apparatus is present which determines the azimuth angle of the object which is to be jammed. Since these apparatus in most instances effect only target locating in azimuth, a jamming antenna combination which follow-up only an azimuth operates with such systems in an optimum fashion. The direction or guidance and target tracking of the jammer antenna is thus controlled by the radar apparatus or reconnaissance apparatus. For the purpose of jamming several objects the jamming antenna can be adjusted by means of a rapid rotary movement from one object to the next so that it successively jams.

Due to a minimum antenna size, light weight construction of the reflectors of metallized foam material and the use of a radome which withstands wind forces the very high rotational speeds up to 300 revolutions per minute and the high accelerations necessary for this purpose are possible. If the threat by various objects is different, in other words, if external protection or self protection must be furnished then switching over from one to the other antenna can be effected during the direction and guidance changes. By the use of a rapid pivotal or swingable antenna combinations constructed according to the invention can provide effective jamming of several objects so as to provide external or foreign protection as well as self protection.

Although the invention has been described with respect to preferred embodiments it is not to be so limited as changes, and modifications can be made which are within the full intended scope as defined by the appended claims.

I claim:

1. An antenna for a jammer which is to protect both a distant object for external protection as well as itself or an object located in its immediate proximity for self-protection, comprising a first antenna provided for external protection and a second antenna for self-protection, and said two antennas exhibit a sharply focused radiation pattern in the horizontal azimuth plane and a radiation pattern (7, 8) optimized for external protection or, respectively, self-protection in the vertical elevation plane in such a manner that the radiation pattern (7) of the first external protection antenna is a $\text{cosec}^2$ pattern in the vertical plane or is at least an approximation to a $\text{cosec}^2$ pattern and the radiation pattern (8) of the second self-protection antenna is a pattern having essentially the shape of a semicircle whose diameter extends in the direction of the zenith but which breaks off at the mean elevation angle range, and said first and second antennas, are structurally combined and means connected to said antennas for rotating them in the horizontal plane about a vertical axis such as surveillance radar antennas.

2. An antenna according to claim 1, characterized in that the level progression of the radiation pattern (8) of the self-protection second antenna in the second plane, at the lowest angle of elevation range, is raised relative to the semicircular progression.

3. An antenna according to claim 1, characterized in said first and second antennas one each composed of a primary radiator (9, 10) and a double-curved reflector (11, 12).

4. An antenna according to claim 3, characterized in that the primary radiators (9, 10) of said first and second antennas are stationarily arranged and the two reflectors (11, 12) are arranged obliquely one above the other, and are mounted to rotate together in back-to-back fashion about a common axis (13).

5. An antenna according to claim 3, characterized in that one of the two primary radiators (19) is stationary and the other (20), together with the two reflectors (21, 22), which are mounted obliquely one above the other with back-to-back relationship are rotatably mounted on a common axis, and a high frequency rotary coupling joint connecting the rotatably mounted primary radiator to the jamming transmitter.

6. An antenna according to claim 3, characterized in that the polarization of the primary radiators (9, 10, 19), respectively, is circular.

7. An antenna according to claim 3, characterized in that the lower (11) of the two reflectors provides external protection and the upper reflector (12) provides self-protection.

8. An antenna according to claim 3, characterized in that said first and second antennas are adjacently mounted such that the two reflectors (26, 27) are positioned approximately at the same level with back-to-back relationship and both reflectors (26, 27), together with the two primary radiators (28, 29), associated with them, are rotatably mounted about a common axis, and a rotary coupling joint (30) provided for electrical connection to the rotatably mounted primary radiators (28, 29).

9. An antenna according to claim 8, characterized in that a switch (31) for switching between external and self-protection is mounted between the single-channel-designed rotary coupling joint (30) and feeders (32, 33) to the two primary radiators (28, 29).

10. An antenna system according to claim 3, characterized in that said first and second antennas are mounted above one another and are commonly rotatably mounted on a common axis, and a rotary coupling joint (41) provided for electrical connection to the rotatably mounted primary radiators (39, 40).

11. An antenna according to claim 10, characterized in that the polarization of the antenna radiation is 45° linearly for said first and second antennas.

12. An antenna according to claim 11, characterized in that a switch (42) for switching between external protection and self-protection is mounted between the single-channel-designed rotary coupling joint (41) and the feeders (43, 44) to the primary radiators (39, 40).

13. An antenna according to claim 1 characterized in that a stationary radome (18), e.g., consisting of a low-loss polyurethane-integral foam, is provided for the purpose of covering the entire antenna structure.

14. An antenna system for a jamming transmitter which is intended to provide remote protection for a remote object as well as protect itself or an object in its immediate proximity characterized in that a single antenna is provided for external protection and for self-protection which, in a first horizontal azimuth plane produces a sharply focused radiation pattern, and, in a second vertical elevation plane, which is perpendicular to the first plane, produces a radiation pattern which, although not optimized to external or foreign protection, or self-protection, respectively, has a mean radiation pattern which is common for both types of protection, and a tilt control for said antenna to tilt it in said second vertical plane to a first position such that its direction of primary radiation corresponds to a direction which is optimum for external protection, and, in the other position corresponds to a direction which is optimum for self-protection, means for rotating said antenna about a vertical axis and tilting it and switch means for switching between external protection and self-protection and controlled commonly with said antenna tilt control.

* * * * *